United States Patent [19]

Lossack et al.

[11] 4,057,100

[45] Nov. 8, 1977

[54] APPARATUS FOR THE LUBRICATION OF HOT HEAD CONTINUOUS CASTING MOLDS

[75] Inventors: Edgar Lossack; Kurt Krämer; Gerd Bulian, all of Bonn, Germany

[73] Assignee: Vereinigte Aluminum-Werke Aktiengesellschaft, Bonn, Germany

[21] Appl. No.: 691,616

[22] Filed: June 1, 1976

[30] Foreign Application Priority Data

June 7, 1975 Germany ..... 2525483

[51] Int. Cl.[2] ..... B22D 11/00

[52] U.S. Cl. ..... 164/418; 164/73

[58] Field of Search ..... 164/73, 268, 273 R

[56] References Cited

U.S. PATENT DOCUMENTS

| | | | |
|---|---|---|---|
| 3,381,741 | 5/1968 | Gardner | 164/73 |
| 3,451,465 | 6/1969 | Moritz | 164/73 X |

FOREIGN PATENT DOCUMENTS

| | | | |
|---|---|---|---|
| 1,110,553 | 4/1968 | United Kingdom | 164/268 |

*Primary Examiner*—Robert D. Baldwin
*Attorney, Agent, or Firm*—Darby & Darby

[57] ABSTRACT

A hot head continuous casting mold process and assembly wherein a separating and/or lubricating agent reservoir is provided in the mold, the agent being applied through channels over the surface of the mold wall by passage from the reservoir into a cavity defined by the mold wall, the hot head and the surface of molten metal. The removal of the agent from the reservoir is due to the pumping action produced during the casting operation by the shifting of the molten liquid meniscus.

6 Claims, 11 Drawing Figures

APPARATUS FOR THE LUBRICATION OF HOT HEAD CONTINUOUS CASTING MOLDS

Figure 1A:
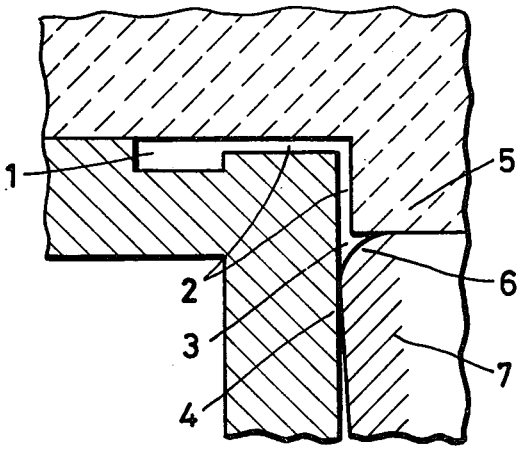

The invention relates to apparatus for the operation of hot head continuous casting molds. More particularly, this invention relates to apparatus for continuously casting metallic materials such as aluminum alloys in a hot head continuous casting mold wherein a separating or lubricating agent is supplied.

"Hot head molds" are well known in the art to be continuous casting mold having fire proof, heat-insulating attachments. More particularly, a "hot head" to which reference is made hereinbelow in connection with continuous casting molds, generally comprises a member which conforms to the shape of the mold with which it is associated. The hot head is formed of a heat-resistant and insulating material, such as a refractory material, which will not deteriorate when in contact with the molten metal to be molded. The head is located at a position contiguous with or adjacent to and extending around the periphery of the top portion of the mold wall. The use of such a hot head provides for a relatively constant withdrawal of heat from the molten metal during the molding operation when using a relatively short mold wall. The use of a short mold has been found to lead to a considerable improvement in the quality of the ingots produced. The use of a hot head allows for a possible variation of the level of the molten metal in the mold, so long as that level does not sink below the lower surface of the hot head, and therefore makes possible, when simultaneously casting several ingots in large foundries, the manufacture of ingots or bars of equal quality without substantial adjustment of the apparatus with respect to molten metal filling height. In order to obtain a smoother ingot surface, a separating or lubricating agent is fed into the mold.

When continuously casting metals such as aluminum it is necessary to apply a separating and/or lubricating agent to the mold wall to prevent the molten metal coming in contact with the cooled mold wall from fusing or adhering to the surface.

The separating and/or lubricating agent, hereinafter called "separator" for short, is generally applied to the mold wall in the form of grease or oil prior to the start of the continuous casting operation. In order to maintain the separating and lubricating effect in the course of the continuous casting operation, new doses of the separator must be applied at certain timed intervals during the operation, which is done in the most simple manner, where molds without hot head are involved, by the addition of small separator amounts in the readily accessible angle between the surface of the liquid or molten metal and the mold wall. It has been proven in practice that when using this method of adding new separator doses, these doses must be very small and well distributed over the entire mold wall in order to prevent deterioration of the ingot surface, which means that both insufficient and excess separator may cause deterioration of the surface of the metal extrusion or casting produced.

Usually, the relubrication or redosing of separator is much more difficult where molds with refractory attachments (hot heads) are involved, because the point of contact between molten metal and cooled mold wall where the separator must be supplied is not readily accessible but covered up by the so-called hot head.

Two solutions of this problem are often applied:

1. Refractory felts or cloths are inserted as wick between hot head and metallic mold. They communicate with a separator reservoir. The wick action of the refractory felt is to assure transportation of the liquid separator to the point of contact between liquid metal and mold wall during the entire continuous casting operation. This solution is unsatisfactory because the wick is compressed between the hot head and mold body and becomes hard in the proximity of the liquid metal due to the influence of heat, despite its refractory nature. Both lead to great losses of the wick properties. Such wicks must usually be replaced after each continuous casting operation.

2. Force application of new separator doses by pumping the separator by means of external pressure through narrow channels, porous inserts or the like provided in the mold wall. The pumping pressure is generated by pumps or by gravity. This procedure is not satisfactory either because it requires an expensive central lubricating system for multiple continuous casting and, above all, easily leads to excess separator addition not uniformly distributed over the mold wall.

The object of the present invention is to obtain redosing or reapplication of separator when casting with hot head molds without having to apply an external pumping pressure and without having to use a wick. Resupplying separator to each mold of a multiple continuous casting machine should be an independent function and require no special servicing work. According to the invention, this is accomplished in that the separator is conveyed from a reservoir provided in the mold through defined gaps or channels between the hot head attachment and the mold into the mold cavity automatically and continuously through the casting process. The separator is transported by utilizing the pressure fluctuation, observed when casting with hot head molds and characteristic of the casting process, in the cavity under the hot head, formed by the surface of the molten metal, the mold wall and the hot head. The pressure fluctuations observed in this cavity originate due to the fact that the meniscus of the liquid metal, i.e., the point of contact between liquid metal and mold wall, periodically shifts back and forth by small amounts with the consequence that the volume of the cavity formed by the meniscus, the mold wall and the hot head periodically increases and decreases.

Measurements taken in this cavity with a pressure gauge have shown that changes between small overpressures and underpressures relative to the external pressure are associated with this process.

According to the invention, these periodic pressure changes are utilized in the manner of a pump effect, together with a suitable mold design, to resupply separator automatically. A separator reservoir is provided in the mold in close proximity to the mold sliding surface, which reservoir may, for example, have the shape of a slot or a channel and communicate through appropriate design features with the cavity formed by the meniscus, the mold wall and the hot head. A separator, capable of flowing, can get from the reservoir to the mold sliding surface in the area of the said cavity and thence between the meniscus and the mold sliding surface where it performs its separating and lubricating actions.

The flow of separator between hot head and mold from the reservoir to the mold sliding surface for resupplying the separator automatically is advantageously made possible by providing in the design a gap which is set by a defined, small distance between hot head and mold, or the flow goes through fine channels which are formed by the hot head attachment resting on a mold surface which was artificially roughened and provided with grooves by systematic knurling or fluting, or by having hot head and mold surfaces with sufficient surface roughness lie on top of each other.

The examples in FIGS. 1 to 3, showing cross-sections and in elevation, respectively, illustrate the hot head mold design according to the invention to assure automatic resupply of separator or relubrication.

Figure 1B:
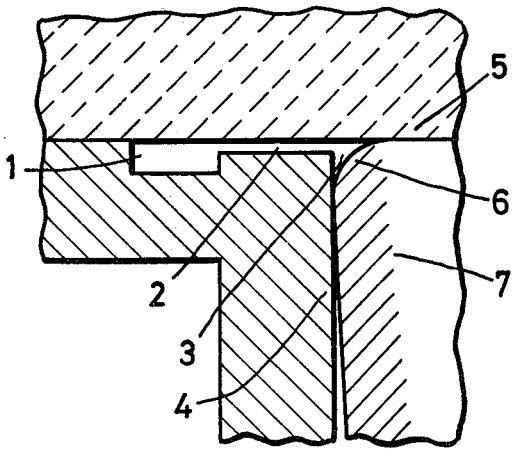
Figure 1C:
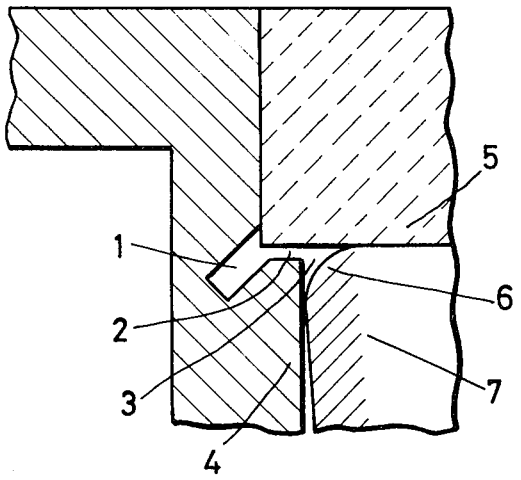

FIGS. 1*a* to 1*c* show, in diagrammatic cross-sections, examples of the communication according to the invention between separator reservoir and mold cavity in the form of a defined gap on various hot head mold embodiments.

FIGS. 2*a* to 2*d* schematically show examples for the shape of the connecting gaps between separator reservoir and mold cavity by defined knurling or fluting on various hot head molds.

Figure 3A:
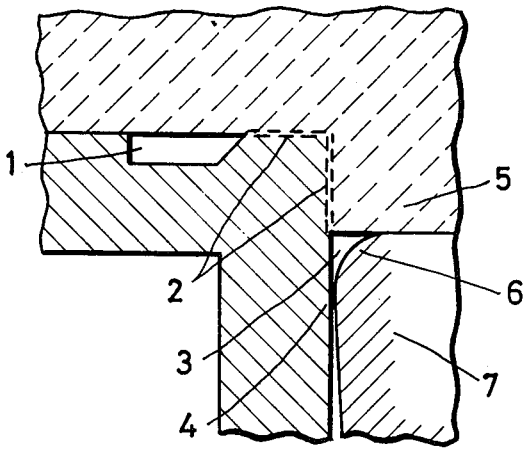
Figure 3B:
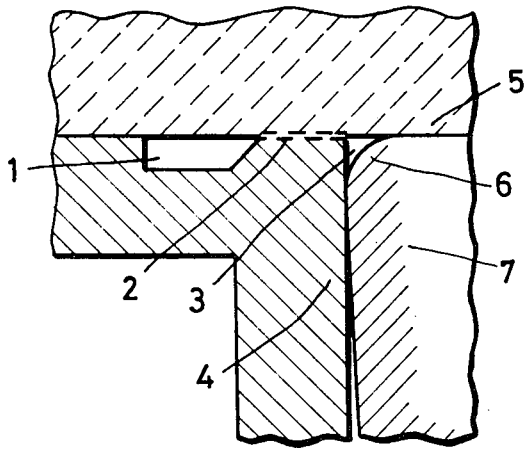
Figure 3C:
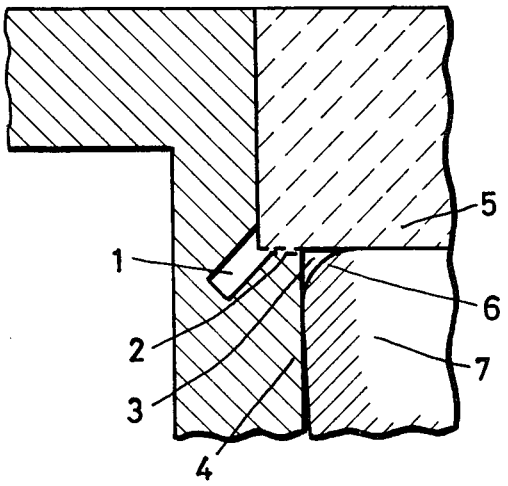

FIGS. 3*a* to 3*c* illustrate schematically, on cross-sections, examples for the formation of connecting channels between separator reservoir and mold cavity by placing naturally rough hot head and mold surfaces of various hot head mold designs on top of each other.

Figure 4:
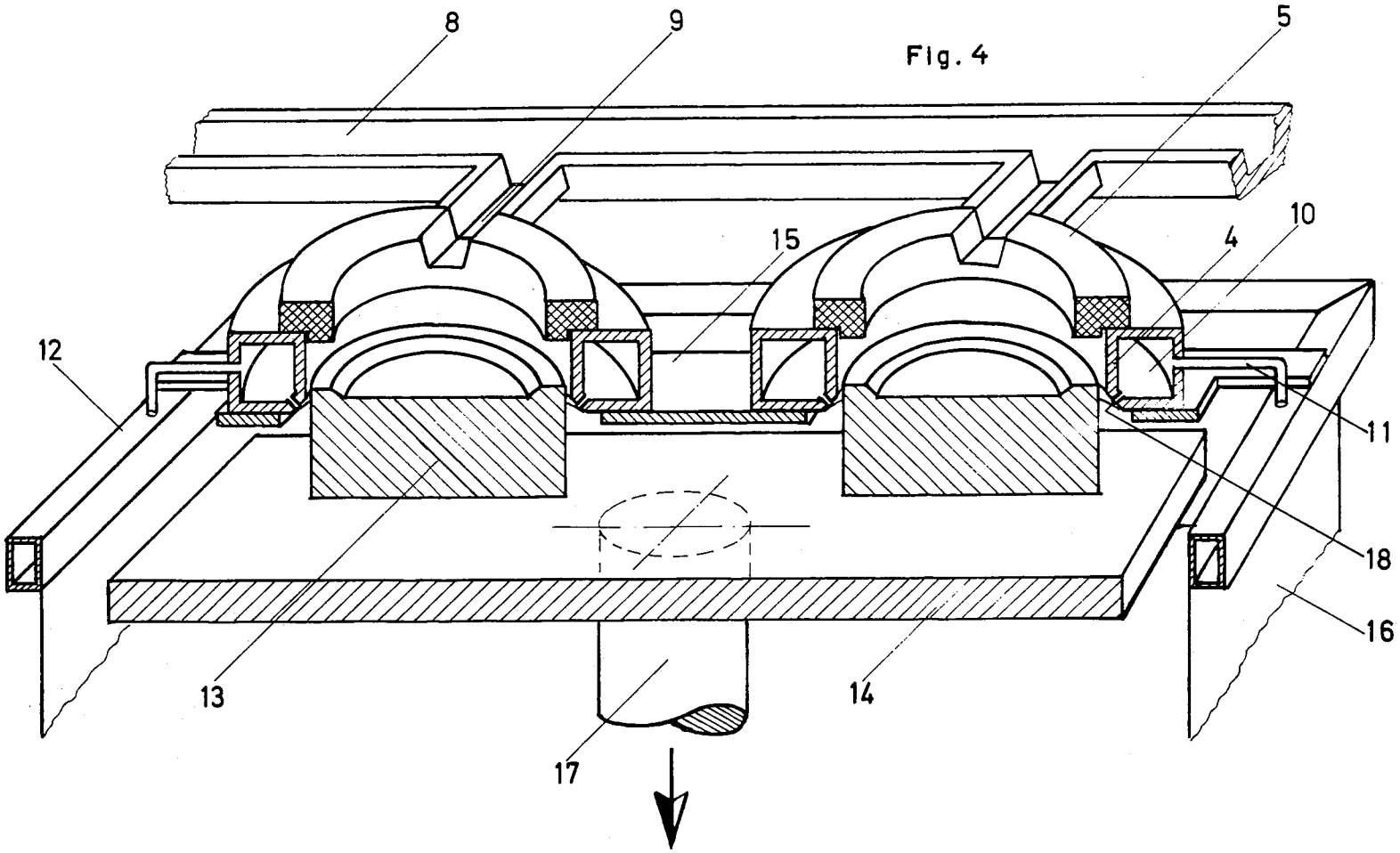

FIG. 4 i a diagrammatic perspective view of a dual hot head continuous casting mold assembly of the type with which the present invention may be utilized.

Referring first to FIG. 4, a hot head continuous casting mold assembly having two identical mold stations is shown prior to the initiation of the casting operation. Each mold station includes a hollow mold having a vertical inner wall 4 which gives the ingot the desired shape. The mold is continuously cooled by introducing water through pipe 11 from supply line 12 into an interior jacket 10 within the mold. The mold is provided with openings 18 at the lower edge of wall 4 into its interior through which the cooling water escapes, the openings 18 being adapted to direct the escaping water onto the ingot being cast during the molding operation to further cool and solidify the metal. A hot head 5 is provided contiguous with and extending around the periphery of the top of each mold. The mold bottom wall 13 is mounted on a vertically movable table 14 which my be lowered and then raised by means of a hydraulic piston 17. In operation, molten metal, such as aluminum, flows through trough 8 and entrance channels 9 into each mold and fills the mold to a level whereby the upper surface of the molten metal is at least equal to the height of the surface of hot head 5 which extends over that mold. Upon the molten metal reaching this height, table 14 and, consequently, mold bottom walls 13, are lowered so that a continuous casting, which has at least partially solidified in the lower part of the mold due to the withdrawal of heat by casting mold wall 4 exists from the casting mold and is further solidified due to its being sprayed with water from openings 18. To the extent that the level of the molten metal is reduced in the mold during this operation, additional molten metal is provided into the mold to maintain a substantially constant level (although small variations in this level do occur).

Referring to FIGS. 1–3, the separator is conveyed from the separator reservoir 1, such as in the form of a reservoir slot, through a fluid path comprising channels or connecting gaps 2 formed in the manner described above, into the cavity 3 which changes periodically due to the fluctuation in the level of the molten metal during the casting operation and which is formed by the mold wall 4, the hot head 5 and the meniscus of the molten metal 6. The separator thereby flows between the originating metal extrusion 7 and the mold wall 4 where it performs its separating and lubricating action.

Figure 2A:
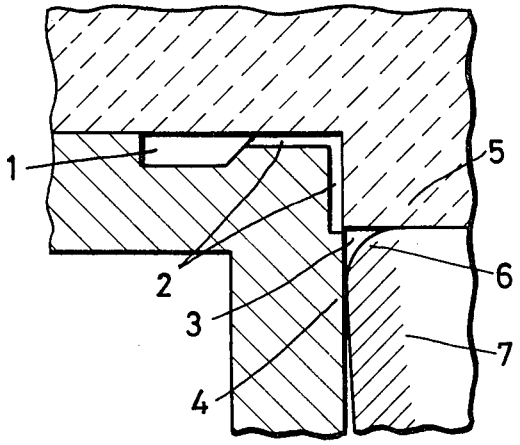
Figure 2B:
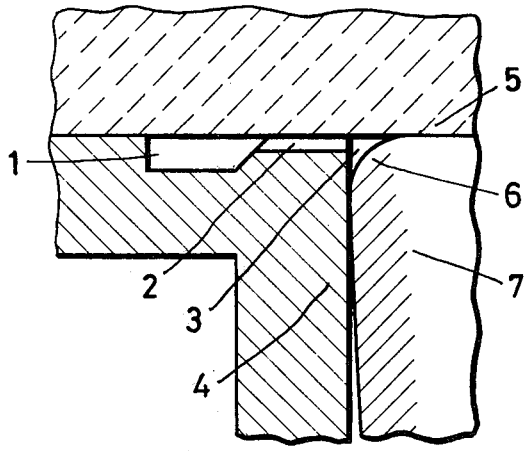
Figure 2C:
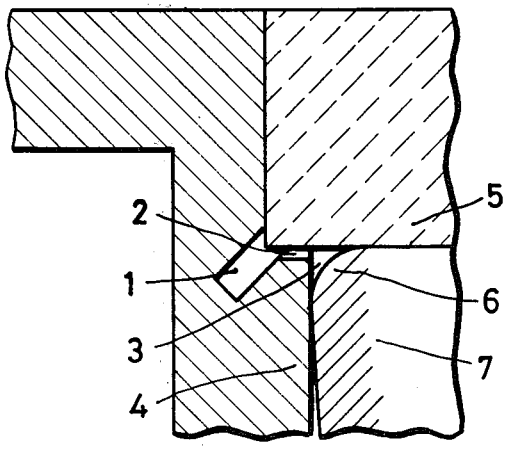
Figure 2D:
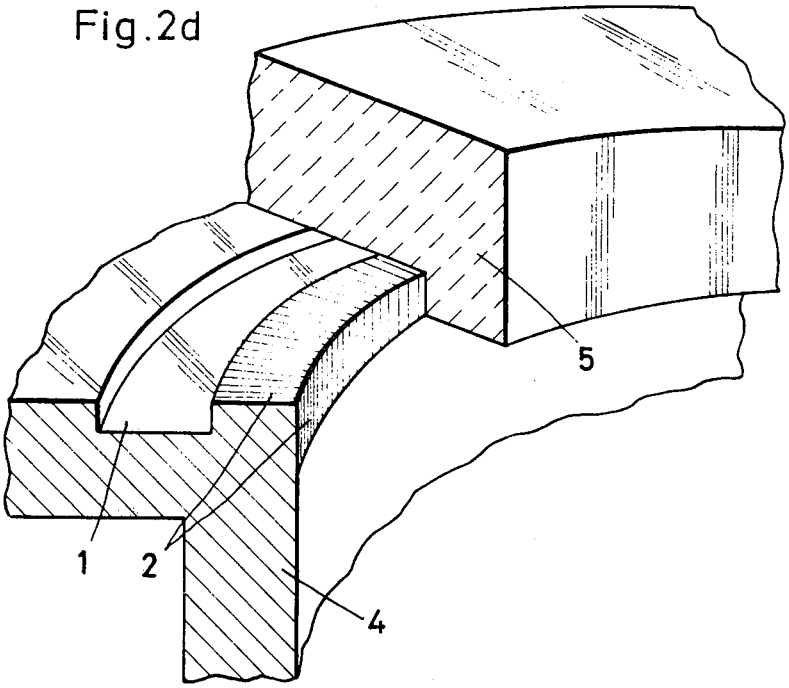

The various mold designs differ in that the hot head 5 according to FIGS. 1*a*, 2*a*, 2*d* and 3*a* also protrudes axially into the mold cavity while this is not the case in FIGS. 1*b*, 2*b* and 3*b*, where the level of the lower hot head surface is substantially coplanar with the upper surface of the mold. In addition, it is evident from FIGS. 1*c*, 2*c* and 3*c* that, contrary to the above-mentioned figures, the separator or lubricant reservoir 1 may be disposed within the mold wall 4 and inclined with respect to the mold axis. The various possibilities shown may possibly also be combined, such as by combining the embodiments according to FIGS. 1*a–c* and 3*a–c* with that according to FIG. 2*d*, i.e., by incorporating the fluting 2 per FIG. 2*d* in the other embodiments and that in such a manner that the flutes run either horizontally and/or in the direction of the mold axis.

It should be noted that any known separating or lubricating lilquid may be used, such as any known vegetable or mineral oil having a suitable viscosity to allow it to flow. For example, rape-oil having a viscosity in the range of 10 to 1000 centistokes at 50° C may be used. Further, the upwards and downwards shifting of the molten liquid meniscus in the mold which contributes to the pumping action of the separating agent is a typical phenomenon which occurs during continuous casting operations and is well known to those skilled in the art.

We claim:

1. Apparatus for continuously casting molten metal comprising:

a mold having a longitudinal axis, an inner, axially extending wall defining a mold cavity, and an upper surface;

a hot head member formed of a heat insulating material having a first portion extending transversly over at least a part of said mold cavity, at least part of said hot head member being contiguous with a surface of said mold, said first portion and axially extending mold wall together with a fluctuating level of molten metal during continuous casting of metal in said mold funtioning to define a variable volume cavity, a liquid reservoir defined in said mold for holding a separating or lubricating agent; and a fluid path communicating between said reservoir and said mold cavity across at least a portion of the interface between said mold and hot head member and around the periphery of said mold, said fluid path opening into the upper half of said liquid reservoir so as to prevent gravity flow of liquid from at least the lower half of said reservoir to said mold cavity, whereby periodic pressure changes within said variable volume cavity are utilized for pumping said separating or lubricating agent from said reservoir to the mold cavity.

2. Apparatus as recited in claim 1 wherein said reservoir is defined by a continuous peripheral slot formed in said mold upper surface.

3. Apparatus as recited in claim 2, wherein said mold upper surface and inner wall intersect along a peripherally extending edge, said slot being spaced from said edge, and said fluid path being defined by channels formed between said hot head member and said mold upper surface, said channels extending from said slot to said peripherally extending edge.

4. Apparatus as recited in claim 3, wherein said first portion of said hot head member axially extends into said mold cavity and includes a surface which at least partially contacts the mold inner wall opposed thereto; said fluid path further being defined by channels formed between said surface of said axially extending hot head portion and said opposed mold inner wall.

5. Apparatus as recited in claim 3 wherein said mold upper surface is fluted, said hot head member contacting said mold upper surface so that said fluting defines said channels.

6. Apparatus as recited in claim 3 wherein said channels are formed by the natural roughness of said mold upper surface and hot head member surface with which it is in contact.

* * * * *